US008132333B2

(12) United States Patent
Seelig

(10) Patent No.: US 8,132,333 B2
(45) Date of Patent: Mar. 13, 2012

(54) PAIR OF COMPASSES

(75) Inventor: Oliver Seelig, Emskirchen (DE)

(73) Assignee: Draw.Tec GmbH & Co. KG, Emskirchen (DE)

( * ) Notice: Subject to any disclaimer, the term of this patent is extended or adjusted under 35 U.S.C. 154(b) by 42 days.

(21) Appl. No.: 12/679,270

(22) PCT Filed: Oct. 10, 2008

(86) PCT No.: PCT/DE2008/001641

§ 371 (c)(1), (2), (4) Date: Mar. 19, 2010

(87) PCT Pub. No.: WO2009/049590

PCT Pub. Date: Apr. 23, 2009

(65) Prior Publication Data

US 2010/0307014 A1 Dec. 9, 2010

(30) Foreign Application Priority Data

Oct. 15, 2007 (DE) ..... 10 2007 049 513

(51) Int. Cl.
*B43L 9/02* (2006.01)

(52) U.S. Cl. ..... 33/27.02

(58) Field of Classification Search ..... 374/27.02, 374/27.03, 27.031, 27.032, 27.033
See application file for complete search history.

(56) References Cited

U.S. PATENT DOCUMENTS

| | | | | | |
|---|---|---|---|---|---|
| 225,436 | A | | 3/1880 | Sullivan | |
| 479,112 | A | | 7/1892 | Bernard | |
| 1,284,372 | A | * | 11/1918 | Lawrenz | 33/27.02 |
| 1,466,712 | A | * | 9/1923 | Green et al. | 33/27.02 |
| 2,297,999 | A | * | 10/1942 | Eubanks | 33/27.02 |
| 2,333,307 | A | * | 11/1943 | Galea | 33/27.02 |
| 3,335,497 | A | * | 8/1967 | Stein et al. | 33/27.02 |
| 3,358,371 | A | * | 12/1967 | Liesong, Sr. | 33/27.02 |
| 3,768,166 | A | * | 10/1973 | Elliott | 33/27.02 |
| 4,843,719 | A | * | 7/1989 | Straten | 33/27.02 |
| 5,555,630 | A | * | 9/1996 | De Souza | 33/27.02 |
| 6,003,231 | A | * | 12/1999 | Leibeck et al. | 33/27.02 |
| 2008/0250658 | A1 | * | 10/2008 | Partes | 33/27.02 |
| 2010/0307014 | A1 | * | 12/2010 | Seelig | 33/27.02 |
| 2011/0000094 | A1 | * | 1/2011 | Partes | 33/27.02 |

FOREIGN PATENT DOCUMENTS

| | | | |
|---|---|---|---|
| DE | 331973 | | 1/1921 |
| DE | 331973 | Y | 1/1921 |
| DE | 911546 | Y | 11/1954 |
| DE | 1921823 | A | 11/1969 |
| DE | 4119136 | | 12/1992 |
| DE | 10 2005 038800 | Y | 12/2006 |
| EP | 0183629 | A | 6/1986 |
| RO | 109305 | | 1/1995 |

* cited by examiner

*Primary Examiner* — Yaritza Guadalupe-McCall
(74) *Attorney, Agent, or Firm* — Lucas & Mercanti, LLP

(57) ABSTRACT

Pair of compasses, having a first compass portion and a second compass portion which are connected together via a hinge having a locking device, which hinge comprises a hinge member mounted rotatably relative to the first or second compass portion, the locking device being spaced from the axis of rotation of the hinge member, the locking device having a threaded element generating a clamping force and cooperating with a nut (11, 12) in order to clamp the hinge member (13) in the locked state against the first and second compass portions, the clamping force acting perpendicular to the axis of rotation of the hinge member (13).

23 Claims, 8 Drawing Sheets

PAIR OF COMPASSES

Figure 1:
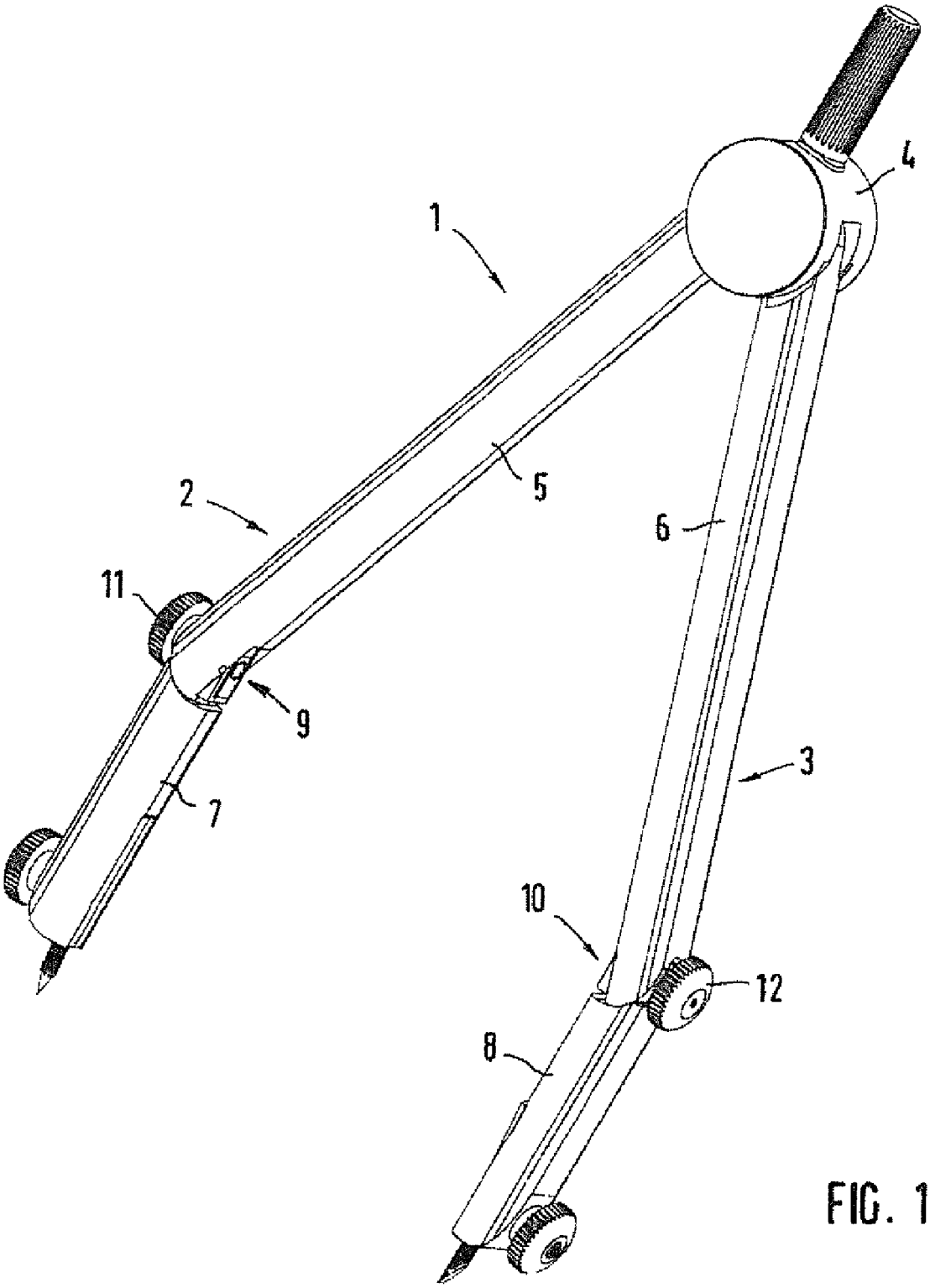

This application is a 371 of PCT/DE2008/001641 filed Oct. 10, 2008 which claimed the priority of DE 10 2007 049 513.9 filed Oct. 15, 2007, both applications are incorporated herein by reference.

The invention relates to a pair of compasses, having a first compass portion and a second compass portion, which are connected together via a hinge having a locking device and comprising a hinge member mounted rotatably relative to the first or second compass portion, wherein the locking device is spaced from the axis of rotation of the hinge member.

In compasses which have a lockable hinge, for a long time the problem has existed that the clamping effect of the hinge is frequently not sufficient. In the past, threaded hinges consisting of metal were used, but these have the disadvantage that they loosen after some time during use and the screw fitting has to be re-tightened. Furthermore, metal hinges are comparatively expensive to manufacture. Likewise, already-riveted hinges have been proposed, but these also do not represent an alternative for reasons of cost.

Usually, in conventional compasses, plastics hinges are used, which are inserted into a U-shaped end portion of a compass portion or compass shank portion and are held by a non-rotatable spindle. A knurled nut screwed on to the spindle wedges the plastics hinge to the compass or compass shank portion. The problem with this arrangement is the use of an extension rod, since then due to the effect of leverage, comparatively strong forces are exerted on the hinge, which cause the hinge to be misadjusted, unintentionally altering the radius of the compasses.

Therefore, the object of the invention is to indicate a pair of compasses with an improved locking device, in which unintentional misadjustment of the hinge is prevented.

To achieve this, it is proposed according to the invention that the locking device has a threaded element generating a clamping force and cooperating with a nut in order to clamp the hinge member against the first and second compass portion in the locked position, the clamping force acting perpendicular to the axis of rotation of the hinge member.

The invention is based on the knowledge that a substantially improved clamping effect compared to the prior art can be achieved if the surfaces generating the locking friction are not located in or directly on the axis of rotation. If these surfaces are disposed remote from the axis of rotation of the hinge, they can absorb substantially greater torques compared to conventional locking devices, so that unintentional loosening and misadjustment of the hinge is prevented.

According to a first modification of the compasses according to the invention, the first compass portion and the second compass portion can be formed on an accessory part of the compasses, in particular on an extension rod.

According to a second, alternative modification of the compasses according to the invention, the first compass portion and the second compass portion can be formed as compass shank portions, forming one compass shank, which is connected via a compass head to a second compass shank.

It is particularly preferred if the hinge member has the basic shape of a half-thrust washer and the contour of the end portion of the first or second compass shank portion cooperating with the hinge member is formed substantially complementary thereto. If there is displacement of the hinge member relative to the compass shank portion, the curved lateral face of the half-thrust washer leads to a rotary movement relative to the opposing face of the compass shank portion and can be fixed in any relative position by means of the locking device.

In the case of locking by means of the spindle, the opposing faces are pressed together, thus fixing the position of the hinge.

To fix an axis of rotation, in the compasses according to the invention it can be provided that the hinge member has on opposite sides pin sections which engage in corresponding recesses in the compass shank portion. The hypothetical connecting line of the two pin sections forms the axis of rotation of the hinge member. Alternatively, the pin sections could also be disposed on the compass shank portion which engages in corresponding recesses in the hinge member. It is also conceivable to use a separate shaft, which permits rotary movement of the hinge member.

It is advantageous that the end portion of the first or second compass shank portion is formed to receive the hinge member approximately in a U-shaped manner. In this case, the hinge member can be received between the two U-shaped shanks so that it is partly covered.

Preferably, the hinge member has a bore or recess for the threaded element formed as a spindle. The spindle may extend through the hinge member and be locked on one side, preferably on the outer side of the compass by means of a nut.

According to a development of the invention, it can be provided that the hinge member is detachably connectable or connected to the compass shank portion disposed remotely from the compass head. In particular, in the compasses according to the invention, the compass shank portion disposed remotely from the compass head may be formed as a compass insert. Thus conventional compass inserts can be connected to the compasses via the hinge member.

The threaded element, formed as a spindle, of the compasses according to the invention has a spindle head, which is mounted non-rotatably relative to the hinge member. Thus unwanted rotation of the spindle during actuation of the locking device is prevented.

In a particularly advantageous development of the compasses according to the invention, it can be provided that inside the hinge member a clamping block is provided having an aperture, through which the spindle is guided and on which the head of the spindle bears. Since the clamping block is movable and the hinge member has an aperture for a compass insert, compass inserts of different pin diameters can be clamped. The clamping is effective automatically upon locking of the hinge. In particular, in the compasses according to the invention, it can be provided that the clamping block and the hinge member are suitable for compass inserts with a pin diameter of 3.5 mm and 4 mm.

In the compasses according to the invention, the hinge member may have on the curved side of the half-thrust washer a projection which limits the rotary movement of the hinge and prevents further rotation of the outer compass shank portion in an outward direction. Preferably, the projection may be movable along a U-shaped end portion of the compass shank portion. The projection may be cylindrical in form, and particularly preferably becomes a modification in which the projection has a bore or recess for the spindle. In this modification, the spindle nut abuts the end face of the projection in the locked state.

In a further embodiment of the invention it can be provided that the hinge member has a projection facing the compass head, which projection is movable along a groove in the compass shank portion and when abutting the end of the groove limits the rotary movement of the hinge. This second projection, which is provided alternatively or additionally to the first projection mentioned on the hinge member, limits the rotary motion of the compass shank portion when a fixed angle is reached.

The compasses according to the invention may also have an adjustment spindle known per se.

A modification of the compasses according to the invention provides that the hinge member forms an integral component with the threaded element. The hinge member and the threaded element are formed in one piece in that the threaded element is for example injection-moulded on to the hinge member.

In the compasses according to the invention, the integral component consisting of the threaded element and the hinge member may have at least one projection or recess, which cooperates with a correspondingly complementarily formed recess or projection on a compass portion, in particular on a compass shank, so as to produce positive locking. By means of the at least one projection, the compass can be firmly fixed in a desired relative position of the two compass portions. To this end, plural adjacently arranged projections or recesses can be disposed on the compass portion.

It is particularly preferred if the at least one projection or the at least one recess is disposed in the region of the transition between the threaded element and the hinge member.

Figure 3A:
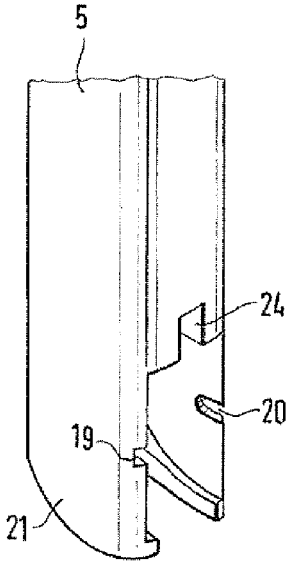
Figure 3B:
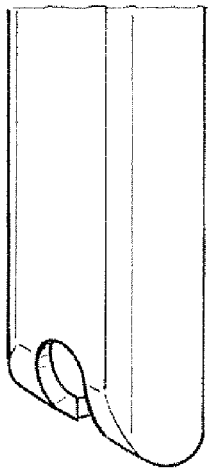
Figure 3C:
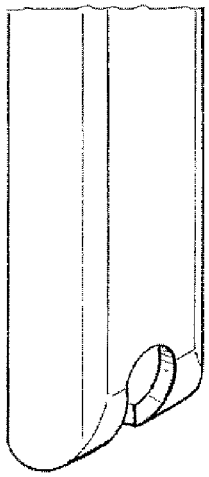
Figure 4A:
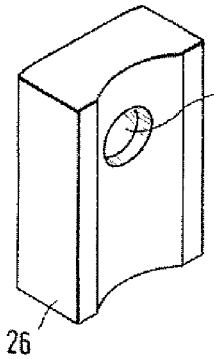
Figure 4B:
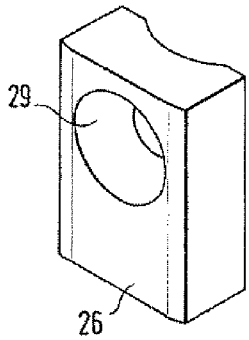
Figure 5:
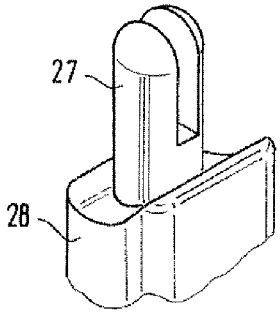
Figure 6A:
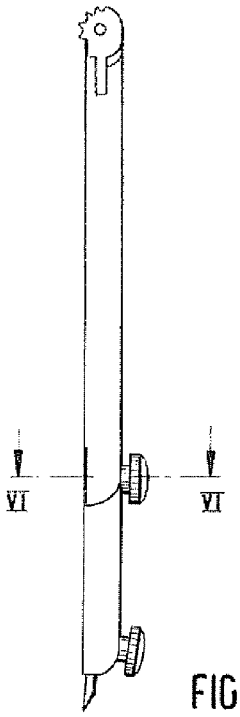
Figure 6B:
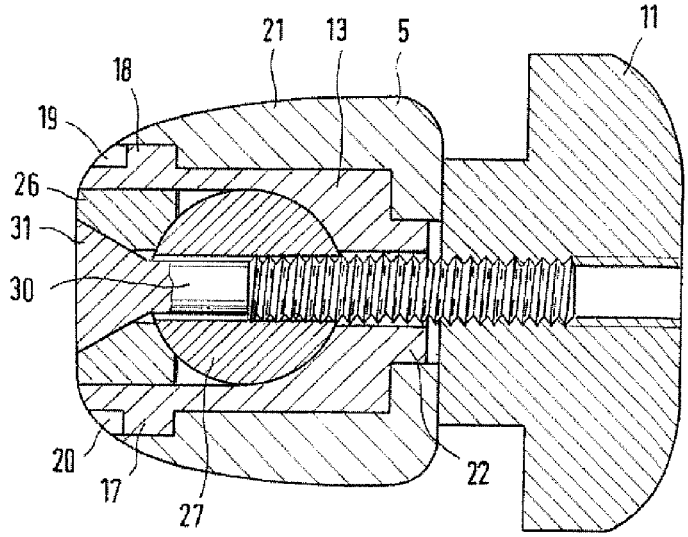
Figure 7A:
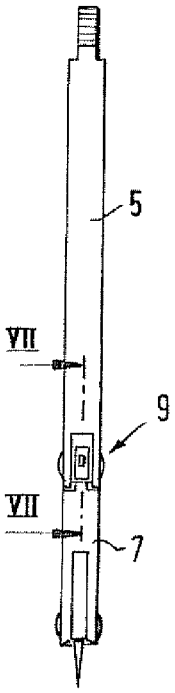
Figure 7B:
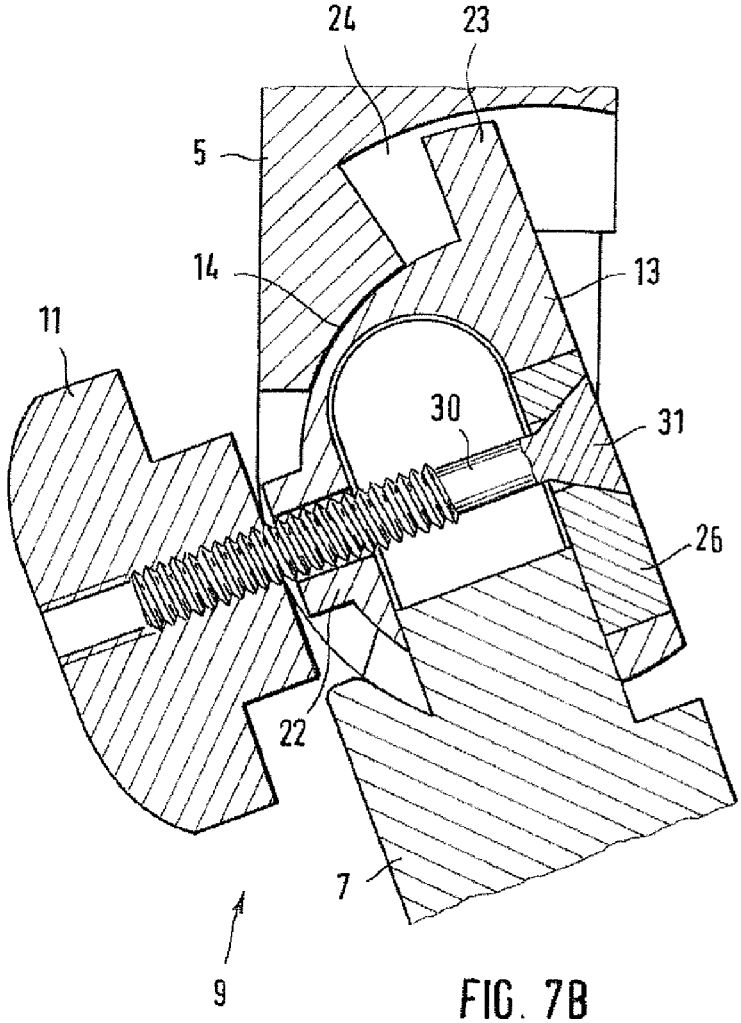
Figure 8:
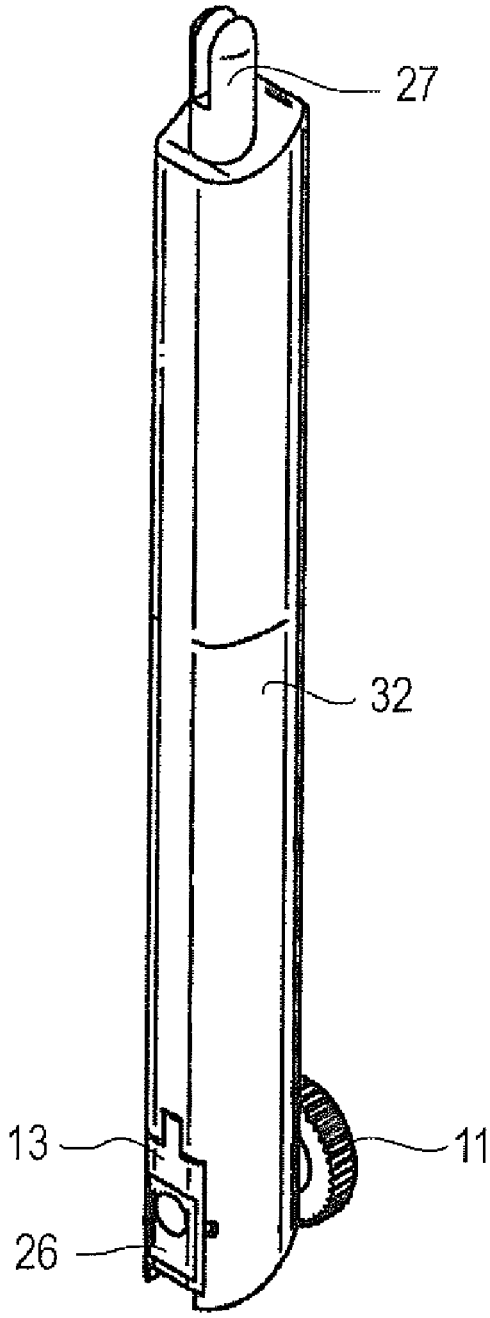
Figure 9A:
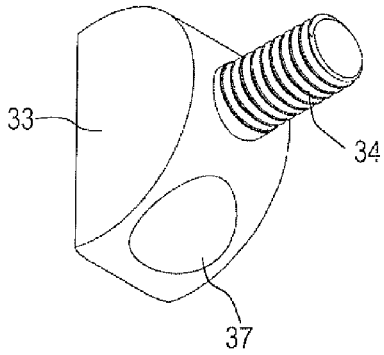
Figure 9B:
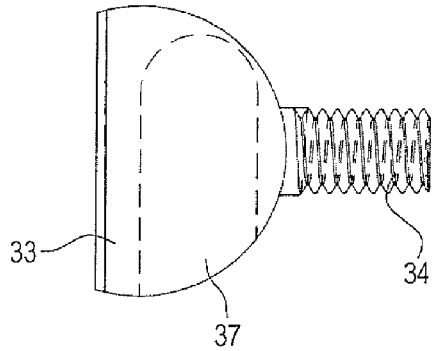
Figure 10A:
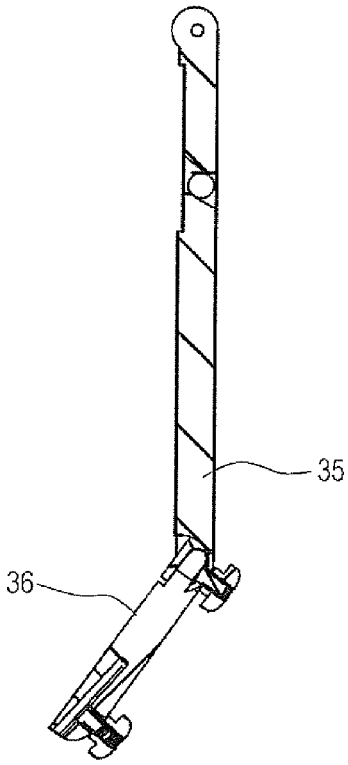
Figure 10B:
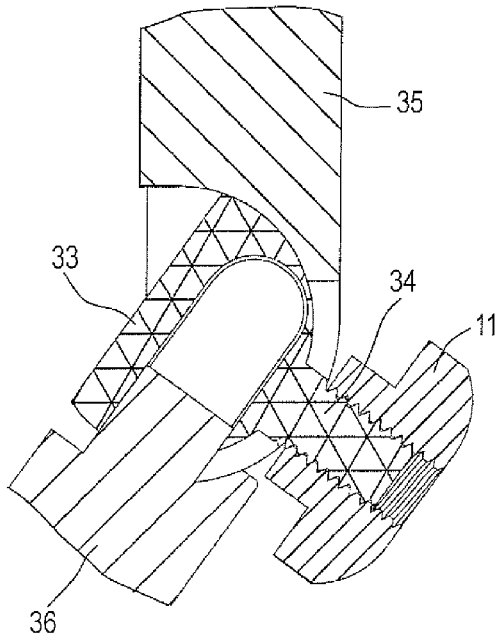
Figure 12A:
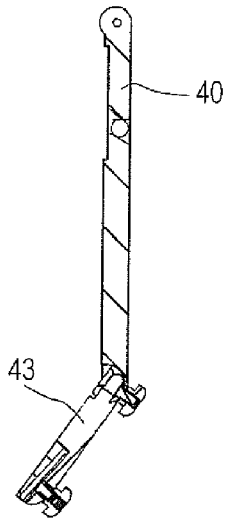
Figure 12B:
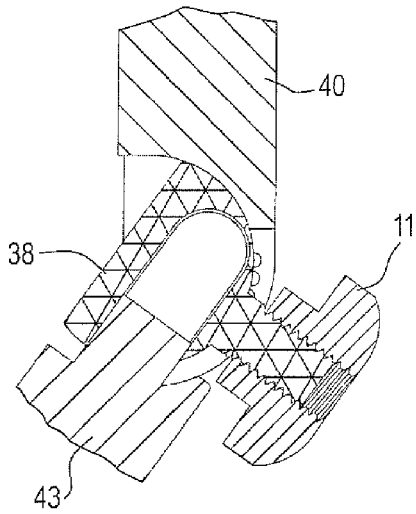
Figure 13A:
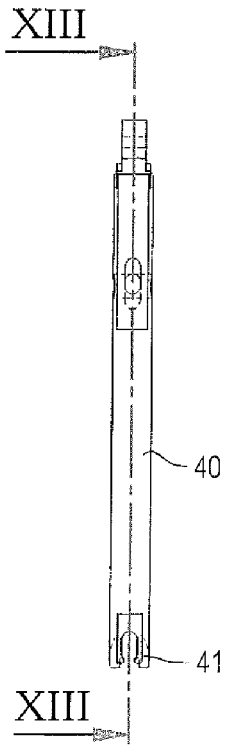
Figure 13B:
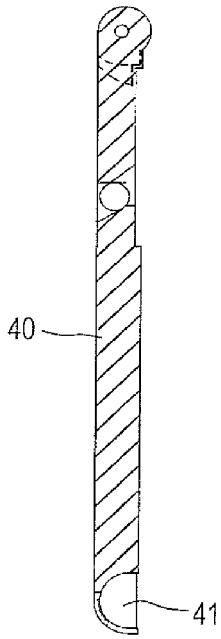
Figure 13C:
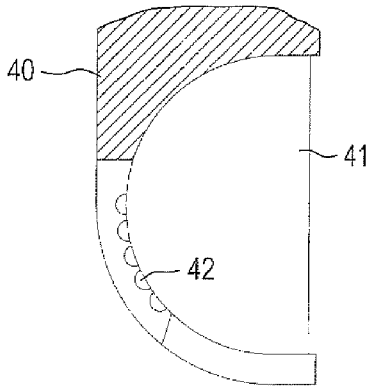

Further advantages and details of the invention are explained more fully below with the aid of embodiments and with reference to the drawings, which are schematic representations showing:

FIG. 1 a pair of compasses according to the invention in a perspective view;

FIG. 2A-2D a hinge member of the compasses according to the invention in various perspective views;

FIG. 3A-3C perspective views of the end portion of the compass shank portion of the compasses according to the invention;

FIGS. 4A and 4B a clamping block of the compasses according to the invention in various views;

FIG. 5 a partial view of a compass insert in the region of the pin;

FIGS. 6A and 6B a side view of a compass shank and an enlarged section view of the hinge along the line VI-VI;

FIGS. 7A and 7B a side view of a compass shank with an angled compass insert and the hinge in an enlarged section view along the line VII-VII;

FIG. 8 an embodiment in which the hinge is formed on an extension rod;

FIGS. 9A and 9B a perspective view and a side view of a hinge member with a threaded element;

FIGS. 10A and 10B a side view in section of an angled compass shank and the hinge in an enlarged section view;

FIG. 11A to 11D various views of a hinge member with a threaded element;

FIGS. 12A and 12B a side view in section of a compass shank and the hinge in an enlarged section view; and FIG. 13A to 13C a front view, a view in section along the line XIII-XIII of a compass shank and an enlarged view of the end portion of the compass shank.

The compass 1 shown in perspective in FIG. 1 comprises compass shanks 2, 3 which are connected together via a compass head 4. Each compass shank 2, 3 consists of a first compass shank portion 5, 6 and a second compass shank portion 7, 8, wherein a first compass shank portion 5, 6 and a second compass shank portion 7, 8 respectively are connected together via a hinge 9, 10. The hinges 9, 10 each have a locking device, with which the second compass shank portions 7, 8 can be fixed in a certain position in order to set a desired radius of the compasses.

Locking is achieved by means of knurled nuts 11, 12 which are mounted laterally on the hinges 9, 10. In the embodiment shown in FIG. 1, the second compass shank portions 7, 8 are formed as compass inserts, the compass shank portion 7 having a needle at its end, and the compass shank portion 8 having a pencil lead at its end.

The hinges 9, 10 of the compasses 1 each have a hinge member 13, which is shown in FIGS. 2A to 2D in various perspective views. The hinge member 13 has substantially the shape of a half-thrust washer and has a curved circumference face 14 extending over about 180° and semi-circular side faces 15, 16.

In the fitted state, the hinge member 13 is located in the region of the end portion of the compass shank portion 5, which is shown in perspective views in FIGS. 3A to 3C. On both semi-circular faces 15, 16, the hinge member has cylindrical projections formed as pin portions 17, 18, which in the fitted state are inserted into recesses 19, 20 in the shank of the U-shaped end portion 21 of the compass shank portion 5. A hypothetical connecting line between the pin portions 17, 18 forms the axis of rotation of the hinge member 13. Roughly in the centre of the circumference face 14, the hinge member 13 has a cylindrical projection 22 with a bore, through which a spindle can be inserted. The hinge member 13 has on one end of the circumference face 14 a further projection 23, which in the embodiment shown has a rectangular cross-section. This projection 23 is movable along a groove 24 in the centre of the U-shaped end portion 21 of the compass shank portion 5. The groove 24 extends in a curved manner in accordance with the semi-circular shape of the hinge member 13. At the end of the groove 24, the projection 23 of the hinge member 13 meets a stop, not shown, which limits the rotary movement of the hinge member 13 and hence limits the angle of aperture of the compasses 1.

Figure 2A:
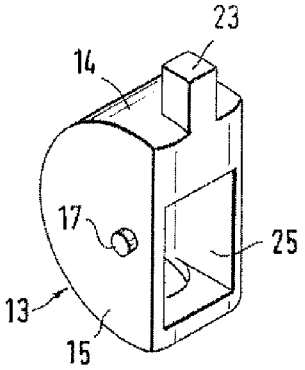
Figure 2B:
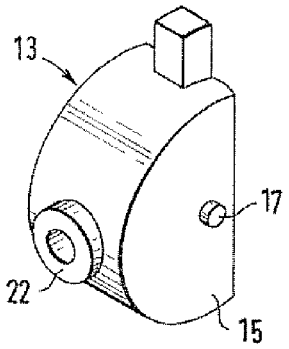
Figure 2C:
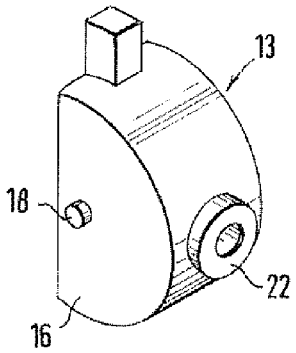
Figure 2D:
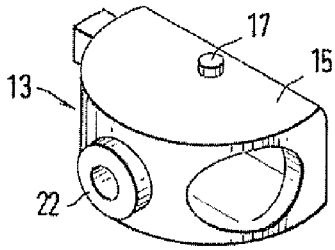

As can best be seen in FIG. 2A, the hinge member 13 has on its flat side an aperture 25, into which the clamping block 26 shown in FIGS. 4A and 4B can be inserted. The clamping block 26 is basically cuboid in shape, but one side is concavely curved and is thus adapted to the outer contour of the pin 27 of a compass insert 28 shown in FIG. 5. The clamping block 26 has an aperture 29, through which a spindle can be inserted.

FIG. 6A shows a side view of a compass shank, and FIG. 6B shows an enlarged view of a section along the line VI-VI. The knurled nut 11 is screwed on to the spindle 30, whose spindle head 31 is so formed that it is inserted non-rotatably into the aperture of the clamping block 26. The clamping block 26 abuts both the spindle head 31 and the U-shaped pin 27 of the compass insert 28 and clamps the compass insert 28 against the hinge member 13, which is in turn pressed against the compass shank portion 5. The clamping force is thus generated by tightening the knurled nut 11. The pin portions 17, 18 projecting laterally from the hinge member 13 and forming the axis of rotation of the hinge member 13 are supported in the recesses 19, 20 of the end portion 21 of the compass shank portion 5.

FIG. 7A shows a side view of the compasses 1, and FIG. 7B shows the region of the hinge in an enlarged view in section along the line VII-VII. In FIG. 7B, the hinge 9 is shown in a bent position. The clamping effect is thus achieved by tightening of the knurled nut 11, which is screwed in with the spindle 30 and whose spindle head 31 presses the clamping block 26 against the lower or outer compass shank portion 7. The hinge member 13 abuts with part of its circumference face 14 the corresponding counter-face of the first or upper compass shank portion 5. In the same way, it abuts the counter-faces of the second, lower compass shank portion 7 so that the compass shank portions 5, 7 are held and clamped by the hinge member 13 in the inserted position. In FIG. 7B, the projection 23 disposed on the hinge member 13 is also shown, which at a certain angle of aperture meets the stop face in the groove 24, which limits the angle of aperture.

FIG. 8 shows an embodiment in which the hinge is formed on an extension rod. The extension rod 32 shown in FIG. 8 has at its upper end a U-shaped pin 27, which is inserted into a corresponding aperture of a compass portion and can be locked. At the opposite end of the extension rod 32 is a hinge member 13 with a clamping block 26 and a nut 11, the hinge member 13 and the cooperating components being constructed identically to the compass components shown in FIGS. 2 to 4. The hinge member 13 has at its free end an aperture into which a compass insert can be inserted.

In FIGS. 9A, 9B, 10A and 10B an embodiment is shown in which the hinge member forms an integral component with the threaded element. The hinge member 33 in the form of a semi-thrust washer has an integrally injection-moulded threaded element 34, which replaces the spindle provided in the preceding embodiments. As is shown in FIG. 10B, a nut 11 can be screwed on to the threaded element in order to clamp the compass shank portions 35, 36 together. The hinge member 33 has a cavity 37, into which the compass shank 36 may be inserted. In FIG. 10B it is shown that the nut 11 generates a clamping force which acts perpendicular to the axis of rotation of the hinge member 33. The hinge member 33 is clamped in the clamped state with its inner face in the region of the cavity 37 against the compass portion 36 and with its outer face against the compass portion 35.

In FIGS. 11A to 11D, 12A, 12B, 13A, 13B and 13C, a further embodiment of a pair of compasses is shown which is similarly constructed to the embodiment in FIGS. 9 and 10.

Figure 11A:
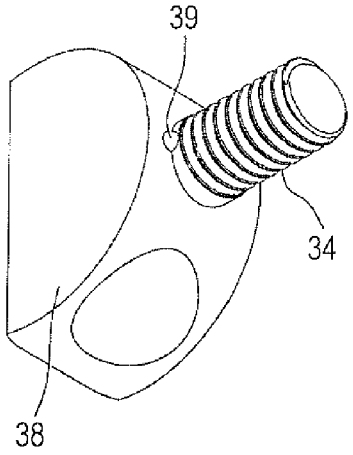
Figure 11B:
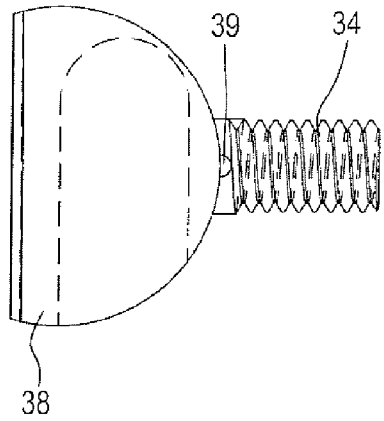
Figure 11C:
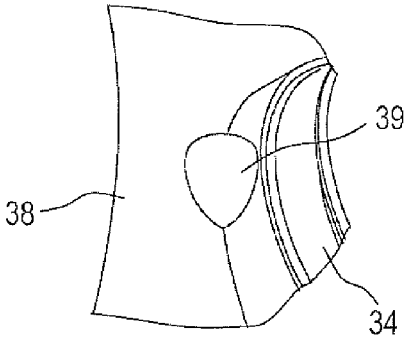
Figure 11D:
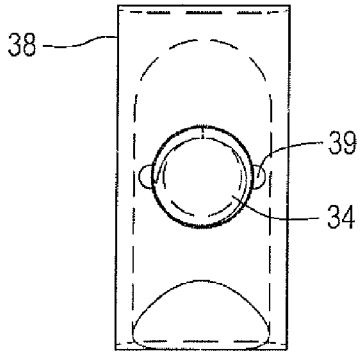

FIG. 11A shows a perspective view of a hinge member 38 which has a threaded element 34. In the region of the transition between the threaded element 34 and the hinge member 38 are two projections 39 on opposite sides of the threaded element 34. FIG. 11B shows the hinge member 38 in a side view, FIG. 11C shows the projection 39 in an enlarged view, and FIG. 11D shows the hinge member 38 in a side view.

FIG. 13A shows a front view, FIG. 13B a section view along the line XIII-XIII of a compass portion 40 and FIG. 13C shows the end portion 41 of the compass portion 40 in an enlarged view. In the rounded region of the end portion 41 of the compass portion 40, this has a plurality of adjacently arranged recesses 42, whose contour is formed in each case complementarily to the contour of a projection 39. With the nut 11 loosened, the compass portion 40 can be rotated in stages relative to a compass portion 43 and then locked again by tightening of the nut 11.

FIGS. 12A and 12B show that the nut 11 clamps the compass portion 40 to the compass portion 43 via the hinge member 38.

Since the clamping faces on which the locking friction acts are remote from the axis of rotation, the hinge can withstand higher forces and torques than hinges used hitherto, so that unintentional misadjustment is prevented.

The invention claimed is:

1. Pair of compasses, having a first compass portion and a second compass portion, which are connected together via a hinge having a locking device and comprising a hinge member mounted rotatably relative to the first or second compass portion, wherein the locking device is spaced from the axis of rotation of the hinge member, characterised in that the locking device has a threaded element generating a clamping force and cooperating with a nut in order to clamp the hinge member in the locked state against the first and second compass portions, wherein the clamping force acts perpendicular to the axis of rotation of the hinge member.

2. Pair of compasses according to claim 1, wherein the first compass portion and the second compass portion are formed on an accessory part of the compass, in particular an extension rod.

3. Pair of compasses according to claim 1, wherein the first compass portion and the second compass portion are formed as compass shank portions which form one compass shank which is connected via a compass head to a second compass shank.

4. Pair of compasses according to claim 3, wherein the hinge member has the basic shape of a semi-thrust washer and the contour of the end portion of the first or second compass shank portion cooperating with the hinge member is formed substantially complementarily thereto.

5. Pair of compasses according to claim 4, wherein the hinge member has on its curved side a projection which limits the rotary movement of the hinge.

6. Pair of compasses according to claim 5, wherein the projection is movable along a recess in the U-shaped end portion of the compass shank portion.

7. Pair of compasses according to claim 5, wherein the projection is cylindrical.

8. Pair of compasses according to claim 5, wherein the projection has a bore or recess for the threaded element preferably formed as a spindle.

9. Pair of compasses according to claim 3, wherein the hinge member has pin portions on opposite sides, which engage in corresponding recesses of the compass shank portion.

10. Pair of compasses according to claim 3, wherein the end portion of the first or second compass shank portion is formed to receive the hinge member in an approximately U-shaped manner.

11. Pair of compasses according to claim 3, wherein the hinge member has a bore or recess for the threaded element formed as a spindle.

12. Pair of compasses according to claim 3, wherein the hinge member is connectable or connected detachably to the compass shank portion disposed remotely from the compass head.

13. Pair of compasses according to claim 12, wherein the compass shank portion disposed remotely from the compass head is formed as a compass insert.

14. Pair of compasses according to claim 3, wherein the threaded element is formed as a spindle which is mounted non-rotatably relative to the hinge member by means of its spindle head.

15. Pair of compasses according to claim 14, wherein inside the hinge member a movable clamping block is disposed having an aperture, through which the spindle is guided and which the spindle head abuts.

16. Pair of compasses according to claim 15, wherein the hinge member has an aperture for a compass insert.

17. Pair of compasses according to claim 16, wherein the clamping block and the hinge member are suitable for compass inserts with a pin diameter of 3.5 mm and 4 mm.

18. Pair of compasses according to claim 1, wherein the hinge member has a projection pointing towards the compass head, which projection is movable along a groove in the compass shank portion and limits the rotary movement of the hinge when abutting the end of the groove.

19. Pair of compasses according to claim 1, wherein it has an adjusting spindle.

20. Pair of compasses according to claim 1, wherein the hinge member forms an intergral component with the threaded element.

21. Pair of compasses according to claim 20, wherein the threaded element is injection-moulded on to the hinge member.

22. Pair of compasses according to claim 20, wherein the integral component consisting of the threaded element and the hinge member has at least one projection or recess, which cooperates with a correspondingly complementarily formed recess or correspondingly complementarily formed projection on a compass portion, in particular on a compass shank, so as to generate positive locking.

23. Pair of compasses according to claim 22, wherein the at least one projection or the at least one recess is disposed in the region of the transition between the threaded element and the hinge member.

* * * * *